US010254066B1

(12) United States Patent
Petersen et al.

(10) Patent No.: US 10,254,066 B1
(45) Date of Patent: Apr. 9, 2019

(54) AMMUNITION ROUND COUNTER AND RELATED METHODS

(71) Applicants: Todd Petersen, Phoenix, AZ (US); Spencer Eisenbarth, Coeur d' Alene, ID (US)

(72) Inventors: Todd Petersen, Phoenix, AZ (US); Spencer Eisenbarth, Coeur d' Alene, ID (US)

( * ) Notice: Subject to any disclaimer, the term of this patent is extended or adjusted under 35 U.S.C. 154(b) by 0 days.

(21) Appl. No.: 15/382,395

(22) Filed: Dec. 16, 2016

(51) Int. Cl.
*F41A 9/29* (2006.01)
*F41A 19/01* (2006.01)

(52) U.S. Cl.
CPC ..... *F41A 19/01* (2013.01); *F41A 9/29* (2013.01)

(58) Field of Classification Search
CPC ..... F41A 9/29; F41A 9/53; F41A 9/82; F41A 9/86; F41A 9/61; F41A 9/62; F41A 9/70; F41A 19/01; F41A 9/57; F41A 9/34; F41A 9/33; F41A 9/32; F41A 9/31; F41A 9/30; F41A 9/79; F41A 9/81
USPC ..... 42/84, 1.01; 89/33.01, 33.14, 33.2, 33.5
See application file for complete search history.

(56) References Cited

U.S. PATENT DOCUMENTS 4,299,158 A * 11/1981 Aloi ..... F41A 9/74 42/1.01
4,506,588 A * 3/1985 Kazanjy ..... F41A 9/82 89/33.25
5,020,414 A 6/1991 Cook
5,212,338 A * 5/1993 Maher ..... F41A 9/10 89/33.04
5,303,495 A * 4/1994 Harthcock ..... F41A 9/62 42/1.02
5,592,769 A * 1/1997 Villani ..... F41A 9/62 42/1.02
5,826,360 A 1/1998 Herold et al.
6,094,850 A * 8/2000 Villani ..... F41A 9/62 42/1.02
7,802,391 B2 9/2010 Quinn et al.
7,921,835 B2 * 4/2011 Campo ..... F41B 11/57 124/51.1
8,046,946 B2 11/2011 Packer et al.
8,109,023 B2 2/2012 Pikielny
(Continued)

FOREIGN PATENT DOCUMENTS

WO 2006042876 4/2006

OTHER PUBLICATIONS

Harcos Labs, Chaingun Project, Oct. 3, 2012, http://www.harcoslabs.com/Chaingun.html.*

(Continued)

*Primary Examiner* — Derrick R Morgan
(74) *Attorney, Agent, or Firm* — IPTechLaw

(57) ABSTRACT

Implementations of ammunition round counting devices may include: a first module and a second module hingedly coupled together, the first module and the second module configured to open and close around a belt of ammunition; a counter module including one of at least two light emitting diodes (LEDs) and at least two light sensors or at least two proximity sensors; a display screen on an outside of the first module; and a battery pack operatively coupled with the counter module. The counter module may be configured to count a number of rounds in the ammunition belt that pass through the first module and the second module.

20 Claims, 4 Drawing Sheets

(56) References Cited

U.S. PATENT DOCUMENTS

| | | | | |
|---|---|---|---|---|
| 8,448,631 | B2 * | 5/2013 | Spicer | F41B 11/57 124/51.1 |
| 8,656,820 | B1 | 2/2014 | Kertis et al. | |
| 8,826,575 | B2 | 9/2014 | Ufer et al. | |
| 9,273,918 | B2 | 3/2016 | Amit et al. | |
| 9,303,937 | B2 | 4/2016 | Acarreta | |
| 2007/0107592 | A1 * | 5/2007 | Snow | F41A 9/68 89/33.02 |
| 2008/0039962 | A1 * | 2/2008 | McRae | F41A 17/06 700/90 |
| 2010/0126485 | A1 * | 5/2010 | Neumaster | F41B 11/57 124/51.1 |
| 2010/0299985 | A1 | 12/2010 | Delgado Acarreta | |
| 2011/0072703 | A1 | 3/2011 | Ferrarini et al. | |
| 2011/0252682 | A1 * | 10/2011 | Delgado Acarreta | F41A 9/62 42/1.02 |
| 2012/0167423 | A1 * | 7/2012 | Kindt | F41A 9/62 42/1.02 |
| 2013/0039655 | A1 * | 2/2013 | Monks | F41B 11/57 398/43 |
| 2013/0180143 | A1 | 7/2013 | Delgado Acarreta | |
| 2013/0180147 | A1 * | 7/2013 | Lupher | F41A 19/58 42/69.01 |
| 2014/0165985 | A1 * | 6/2014 | Bryngelson | A63H 37/00 124/82 |
| 2015/0113847 | A1 * | 4/2015 | Acarreta | F41A 9/62 42/1.01 |
| 2016/0069629 | A1 | 3/2016 | Seckman | |

OTHER PUBLICATIONS

DillonAero, Ammunition Counter, Jan. 12, 2016, http://dillonaero.com/wp-content/uploads/2016/07/42-DADS0057-Ammunition-counter-01-12-16.pdf.*

"Nerf Magazine Ammo Counter," Instructables.com, http://www.instructables.com/id/Nerf-Magazine-Ammo-Counter-Mk-I/?ALLSTEPS (last visited Jun. 16, 2016).

* cited by examiner

AMMUNITION ROUND COUNTER AND RELATED METHODS

BACKGROUND

1. Technical Field

Aspects of this document relate generally to devices for counting ammunition. Particular implementations may be used for ammunition in automatic or semi-automatic weapons, such as linked or belted ammunition.

2. Background

Conventionally, to keep track of ammunition a count of rounds is performed before and after use of a weapon. Counting may be done manually by hand or using a counting device such as that described in U.S. Pat. No. 5,020,414 granted to Mark A. Cook, the disclosure of which is hereby incorporated entirely by reference.

SUMMARY

Implementations of ammunition round counting devices may include: a first module and a second module coupled together, the first module and the second module configured to open and close around a belt of ammunition; a counter module including one of at least two proximity sensors or at least two light emitting diodes (LEDs); a display screen on an outside of the first module; and a battery pack operatively coupled with the counter module. The counter module may be configured to count a number of rounds in the ammunition belt that pass through the first module and the second module.

Implementations of ammunition round counting devices may include one, all, or any of the following:

The display screen may be reversibly couplable into the first module.

The display screen may be a liquid crystal display (LCD) screen.

Implementations of ammunition round counting devices may also include a button on the outside of the first module, the button may be configured to allow a user to toggle the counter module between two or more modes of the display screen.

The at least two LEDs and at least two light sensors may be configured to count a round in the ammunition belt as the round interrupts the light beam emitted from the at least two LEDs and received by the at least two light sensors.

The number of rounds in the ammunition belt may be counted in a first direction through the first module and the second module and in a second direction through the first module and the second module.

The distance between the one of at least two proximity sensors or at least two LEDs may be a predetermined distance.

The predetermined distance may be 0.7215 inches.

The counter module may be configured to count up to 3000 rounds of ammunition per minute.

Implementations of ammunition round counting devices may include: a first module; a second module; a coupler coupled at a first end of the first module and coupled at a first end of the second module where the coupler may be configured to allow the first module and the second module to open and close around a belt of ammunition. The device may include a counter module including a first section having a liquid crystal display (LCD) screen, where the counter module couples into the first module. One of at least two proximity sensors or at least two light emitting diodes (LEDs) may be included in the counter module. A button may be included on an outside surface of the first section of the counter module; and a battery pack may be included in the second module. The counter module may be configured to count a number of rounds of ammunition passing between the first module and the second module using one of the at least two proximity sensors or the at least two LEDs. The first section of the counter module may be reversibly couplable into the first module.

Implementations of ammunition round counting devices may include one, all, or any of the following:

The button may be configured to allow a user to toggle the counter module between the two or more modes of the LCD screen.

The distance between one of the at least two proximity sensors or the at least two LEDs may be a predetermined distance.

The predetermined distance may be 0.7215 inches.

The counter module may be configured to count up to 3000 rounds of ammunition per minute.

The number of rounds in the ammunition belt may be counted in a first direction through the first module and the second module and may also be counted in a second direction through the first module and the second module.

Implementations of ammunition round counting devices may utilize implementations of a for counting ammunition. Implementations of the method may include: placing a belt of ammunition between a first module and a second module; passing the belt of ammunition adjacent one of two or more proximity sensor and two or more LEDs included in the first module; and creating at least one state through detecting the passing of each round of ammunition in the belt of ammunition using the one of the two or more proximity sensors and the two or more LEDs. The method may also include using the at least one state to count each round of ammunition in the belt of ammunition as having passed through the first module and the second module using a processor and a memory included in the first module, the second module, or both the first module and second module.

Implementations of a method for counting using ammunition round counting devices may include one, all, or any of the following:

The two or more LEDs may be pulsed toward two or more light sensors included in the second module at a 2 kHz frequency and the at least one state includes 5 to 10 pulses.

The method may further include interrupting a beam of light emitted by the two or more LEDs using a round of ammunition in the belt of ammunition and detecting the interruption using two or more light sensors.

The method may further include at least three states which may include 1,0; 0,1; and 0,0.

The round of ammunition can be counted in a first direction through the first module and the second module and a second direction through the first module and the second module.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended ammunition round counting device will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such ammunition round counting devices and implementing components and methods, consistent with the intended operation and methods.

Figure 1:
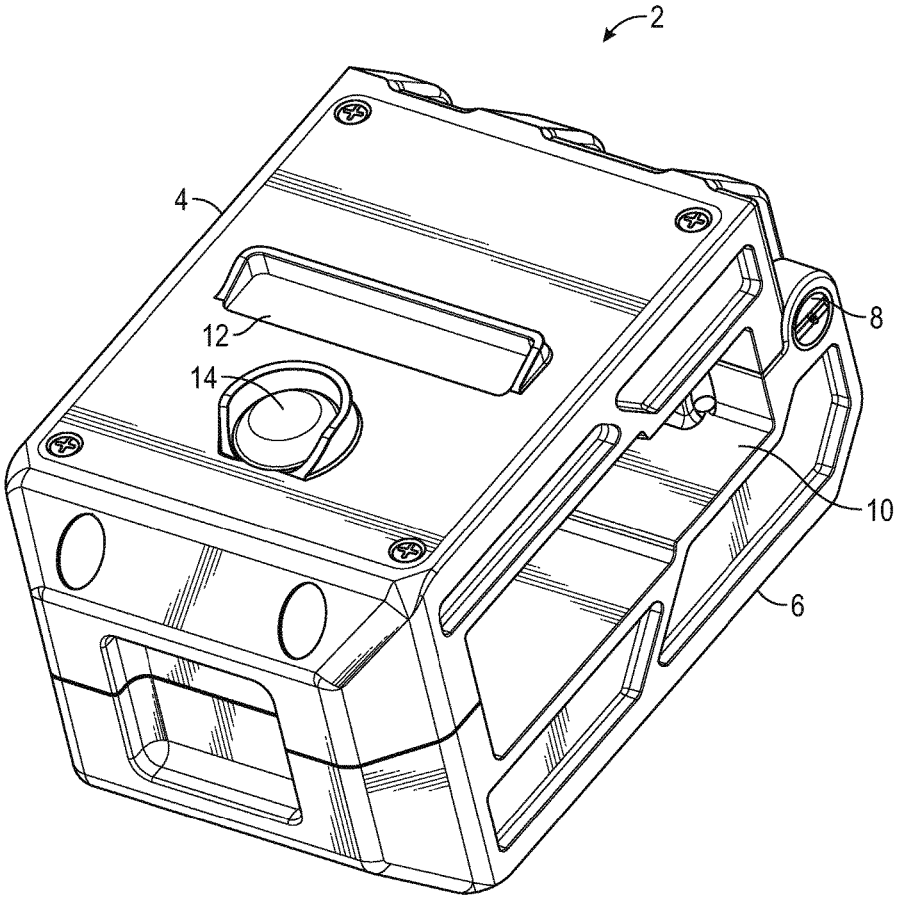
FIG. 1 is a top perspective view of an implementation of an ammunition round counting device in a closed position.

Referring to FIG. 1, an implementation of an ammunition round counting device (device) 2 is illustrated. In this particular implementation, the device 2 includes a first module 4 and a second module 6 which are coupled together through a hinge 8. In other implementations, the modules 4 and 6 may be coupled together through other suitable fasteners/couplers, such as magnetic fasteners, screws, bolts and the like. In various implementations, the first module 4 and the second module 6 are sized and dimensioned to open and close around a belt of ammunition. The ammunition may fit in a space 10 between the first module 4 and the second module 6. An ammunition round counting device 2 may be configured to be used with belted/linked rounds of ammunition. The device 2 includes a counter module which is configured to count the number of rounds in the ammunition belt that pass through the first module 4 and the second module 6. Various sizes of ammunition that may be used with an implementation of an ammunition round counting device include, rounds for an M16, M249, M1919, and any other firearm that uses belted/linked ammunition whether carried by personnel or mounted in a vehicle or aircraft.

Various implementations of ammunition round counting devices also include a display screen 12 on an outside of the first module 4. In various implementations, the display screen may be a liquid crystal display (LCD) screen. In other implementations, the display screen may also include, but is not limited to, a light emitting diode (LED) display, a nixie tubes display, a segment display, and any other suitable display screen. The display screen may be operatively coupled with a counting module to display the information determined by the counting module, which will be described in greater detail later below. The device 2 may also include a button 14 on the outside of the first module 4. The button 14 may be configured to allow a user to toggle the counter module between two or more different display modes (modes) of the display screen 12. The counting module includes a processor and a memory, which are used to collect, process, store, and display the data relating to the ammunition rounds passed through the system. The processor and memory may be included in either the first module, the second module, or in both the first module and second module, depending on the implementation.

Figure 2:
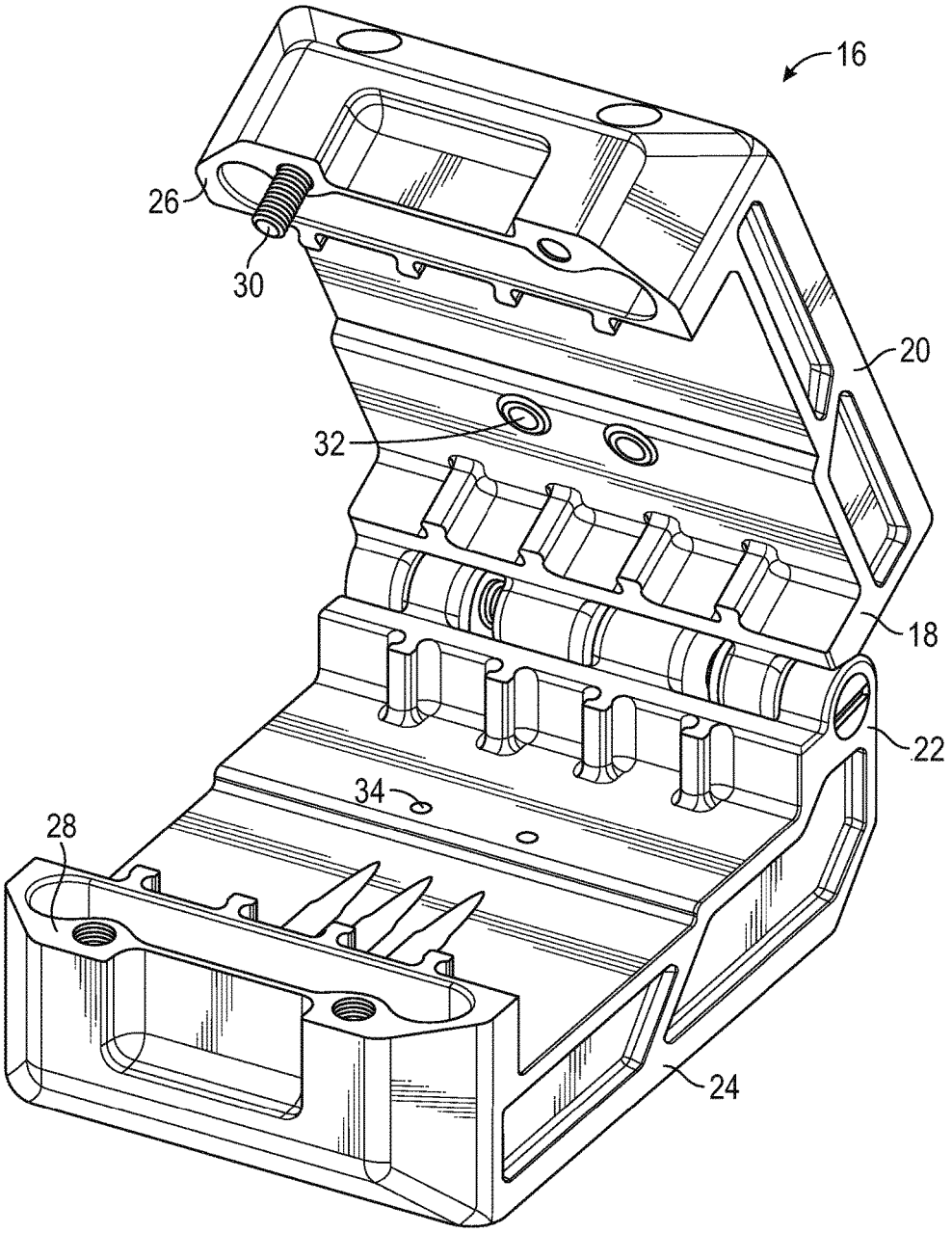
FIG. 2 is a front perspective view of an implementation of an ammunition round counting device in an open position.

Referring now to FIG. 2, an implementation of an ammunition round counting device 16 in an open position is illustrated. In this position, a first end 18 of the first module 20 can be seen coupled at a first end 22 of the second module 24. An electrical connection may be included in the coupler to electrically couple the first module with the second module. By non-limiting example the electrical connection may include a wire, a bolt, a latch, or other suitable modes of providing for an electrical connection. In this position, a belt of ammunition can be positioned in the space formed between the "clamshell" space formed between the first module 20 and the second module 24. When the ammunition round counting device closes around a belt of ammunition, a second end 26 of the first module 20 contacts a second end 28 of the second module 24. In various implementations, the first module 20 and the second module 24 may be locked together through a fastener 30. The fastener 30 may include a screw, a latch, a clasp, a button, a magnetic fastener and any other suitable coupling device known in the art.

Also visible in this view of the device 16 are at least two light emitting diodes (LEDs) 32 and at least two light sensors 24 included in the counter module. In other implementations, at least two proximity sensors may be used in place of the at least two LEDs and the at least two light sensors. The least two proximity sensors may each include a circuit that includes at least one inductor and at least one capacitor arranged in an LC circuit as described hereafter. The at least two proximity sensors may be included in the first module in a similar position to the at least two LEDs or included in the second module in a similar position to the at least two light sensors. The distance between the at least two LEDs 32 (or proximity sensors) and, where LEDs are used, the distance between the at least two light sensors 34 may be a predetermined distance. In particular implementations, the predetermined distance is 0.7215 inches, a distance that has been determined to permit the device to operate with a variety of ammunition round sizes. In other implementations, other predetermined distances may be used depending on the size of the rounds of ammunition, the speed of the ammunition and other factors that may affect counting the rounds of ammunition.

In various implementations, a method for counting ammunition may include pulsing the two or more LEDs 32 in the first module 20 to produce light that is then directed toward the two or more light sensors 34 included in the second module. The two or more LEDs 32 may be pulsed at a frequency of 2 kHz in particular implementations, though other frequencies may be used in other implementations depending on the LED type used and desired ammunition round types. In various implementations, pulsing the two or more LEDs 32 on a frequency of 2 kHz may allow the device to save power while continuing to accurately count the rounds of ammunition. A beam of light emitted by each of the two or more LEDs 32 is interrupted using a round of ammunition in the belt of ammunition as the ammunition passes through the device during counting/firing operations.

At least three states are created through interrupting the beam of light and corresponding data values are stored in the memory of the counting module using the processor. In one implementation, the at least three states may include 1,0; 0,1; and 0,0 as discussed in more detail hereafter. In implementations including a fourth state, the fourth state may include 1,1. In some implementations, each state may include 5 to 10 light pulses. In other implementations, more light pulses may be included in each state. The at least three states may be used to count each round of ammunition as it passes through the space between the first module 20 and the second module 24 of the device, but without touching the ammunition or ammunition belt to aid in counting. In various implementations, the rounds of ammunition can be counted in a first direction through the first module and the second module and in a second direction through the first module and the second module. The counter module may be configured to count up to 3,000 rounds of ammunition per minute. In various other implementations, the device may be configured to count a larger amount of rounds of ammunition per minute.

In various methods of counting ammunition rounds using an ammunition round counting device at least three states are required to obtain a full quadrature. A quadrature will be understood by those skilled in the art, as representative of the relationship between two data points that are electrically 90 degrees out of phase with each other. Each full cycle includes four phases or states. In order to count the rounds of ammunition as they pass through the counter device, at least three states are needed. One state may be when no rounds interrupt the two or more LED beams of light received by the two or more light sensors, which is 0,0; another state may be when a round interrupts a first LED beam of light at a first light sensor position, which is 1,0; and still another state may be when a round interrupts a second LED beam of light at a second light sensor position, which is 0,1. In other implementations, an additional state may be used in counting rounds of ammunition using an ammunition round counting device. The additional state may include a first round interrupting a first LED beam of light at a first sensor and a second round interrupting a second LED beam of light at a second sensor, which may be 1,1.

In other implementations of ammunition round counting devices, more than two LEDs and more than two light sensors may be used in counting rounds of ammunition. In such implementations, more states would be required to achieve a full quadrature. The number of states required is 2', where "n" is the number of sensors in the device. For example, 3 sensors would require at least 5 states, 4 sensors would require at least 7 states, and so forth.

Other implementations of a method for counting rounds of ammunition may include an inductor and capacitor circuit, also referred to as an LC. For this method, a small inductor is placed near the path of the rounds of ammunition. As the round move through the ammunition counting device near the inductor a tuned circuit incorporating the inductor and a capacitor may be used to measure the effective inductance of the circuit. The LC may detect two difference inductance values. One value (0 or 1) is detected when a round is near the sensor/inductor and another value is (1 or 0) detected when a space between the rounds is near the sensor/inductor. The two difference inductance values are equivalent to the states in the method using at least two LEDs and at least two light sensors and are similarly stored and processed in the memory and by the processor. As described previously, the at least two LC circuits may be used in place of the at least two LEDs and at least two light sensors. Various inductor and capacitor combinations may be used in implementations of an ammunition round counting device. By non-limiting example, the inductor may be a 470 μH Radial Inductor Part #11R474C and the capacitor may include a 220 pf Chip Capacitor Part # GRM1555C1H221JA01D both manufactured by Murata Manufacturing Company, Ltd. of Kyoto, Japan.

The previously described three state method of counting linked ammunition allows implementations of the device to count in a first direction and also in a second direction as previously described. A first direction may be defined as the rounds of ammunition moving from left to right when looking at the device in FIG. 2. A second direction may be defined as the rounds moving from right to left when looking at the device as in FIG. 2. The bi-directionality of the counting allows a user to place the device on a belt of ammunition quickly without having to worry if the orientation is correct before beginning to fire rounds. This also allows the user to gain useful information even if he/she forgets to check how the device is positioned on the rounds of ammunition. As will be described later, the display screen may also be repositioned to allow users to position the device in multiple orientations on a belt of ammunition. This method also takes into account the changes in spacing between the linked rounds of ammunition as the rounds move through the device. The spacing between the rounds changes as the belt of ammunition is in tension or compression, which changes dynamically during feeding and firing operations.

In other system implementations, a method of counting ammunition in a single direction may be used. In these method implementations, less than three states are needed to count the ammunition. In particular implementations, just one state is used. In such implementations, the state is 1 when an ammunition round is detected by an LED or proximity sensor and the state is 0 when an ammunition round is not detected. By counting the sequence of 1s and 0s in the single state, the total number of rounds of ammunition in the belt passing adjacent the LED/light sensor combination or proximity sensor can be detected. In such implementations, the counting can take place if the belt of ammunition is passed in either direction through the device.

Figure 3:
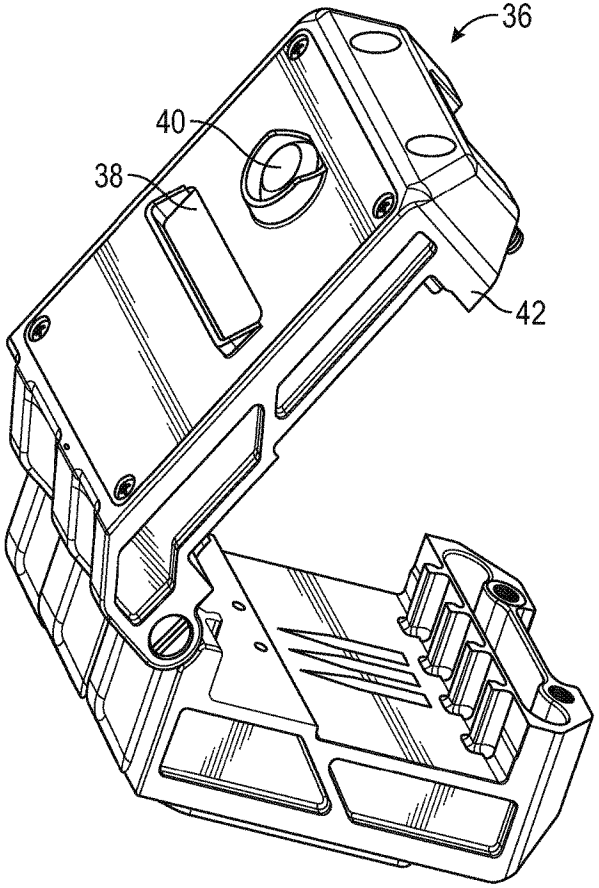
FIG. 3 is a side view of an implementation of an ammunition round counting device in an open position.

Referring now to FIG. 3, a side view of an implementation of an ammunition round counting device 36 is illustrated. In this view, the electrical contacts of the display screen 38 are illustrated. The display screen 38 is configured to display two or more different modes received from the counter module, including but not limited to, various statistics, number of rounds passing through the counter module, total rounds fired during a measuring period, and so forth. A button 40 located on an outside of the first module 42, is configured to allow a user to the toggle counter module between the two or more modes of the display screen 38.

Figure 4:
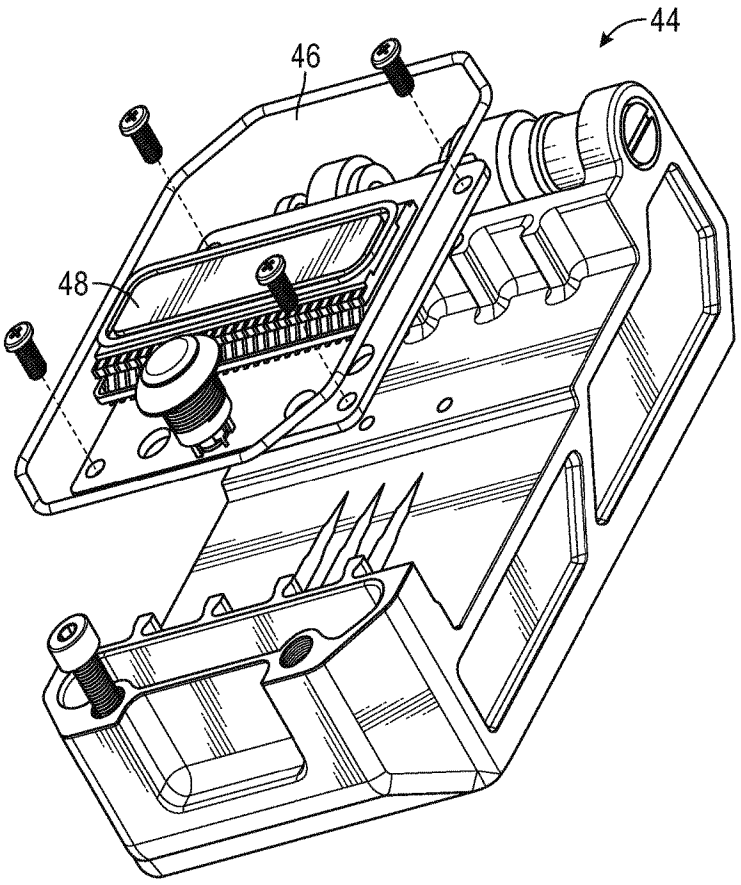
FIG. 4 is a see-through view of a first module of an implementation of an ammunition round counting device.

Referring now to FIG. 4, an implementation of an ammunition counting device 44 is illustrated. Here, the inside of the first module 46 is illustrated. The display screen 48 is electrically coupled to the counter module. The display screen 48 is reversibly couplable into the first module 46, in various implementations, allowing the display screen to be removed and re-coupled into the device in an opposite direction to allow the user to read the display more easily. This feature allows the user to change the display orientation of the display screen without needing to remove the device 44 from the belt of ammunition.

Figures 5, 6, 7:
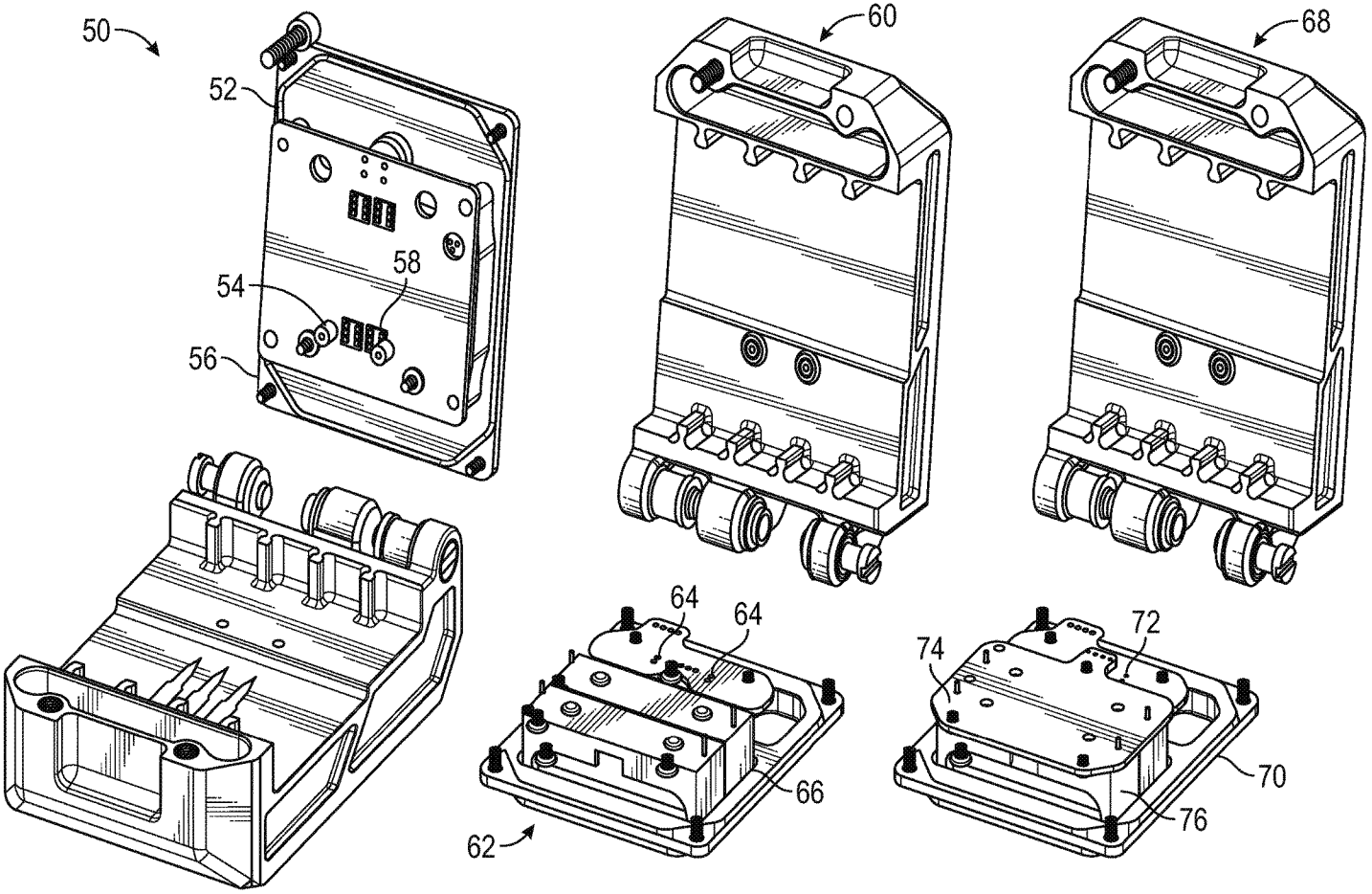
FIG. 5 is a front view of an implementation of an ammunition counting device in an open position with a see-through view of the cover of the first module.
FIG. 6 is a front view of an implementation of an ammunition counting device in an open position with a see-through view of the cover of the second module.
FIG. 7 is a front view of an implementation of an ammunition counting device in an open position with a see-through view of the cover of the second module.

Referring now to FIG. 5, a front view an implementation of an ammunition counting device 50 is illustrated. In this illustration, the outside of the first module 52 is see-through to aid in describing the device 50. The at least two LEDs 54 are visible near the first end 56 of the inside of the first module 52. The electrical connections 54 of the display screen are also visible on the inside of the first module 52.

Referring now to FIG. 6, a front view of an implementation of an ammunition counting device 60 is illustrated. In this view, the outside of the second module 62 is see-through. The at least two light sensors 64 are near the first end of the inside of the second module 62. In various implementations, the at least two light sensors 64 may be located in different positions within the counter module. A battery pack 66 is included in the second module 62 in various implementations. The battery pack 66 may be operatively coupled with the counter module including the at least two LEDs light pulsing, the at least two light sensors and the display screen. In various implementations, the battery pack 66 may be one or more batteries. The batteries may include but are not limited to alkaline batteries, lithium-ion batteries, rechargeable batteries, and any other suitable batteries known in the art. As described previously, the method for counting ammunition rounds utilizes a 2 kHz frequency pulse for the at least two LEDs to conserve battery power. The display screen may also be configured to dim or turn off between uses to conserve battery power.

Referring now to FIG. 7, an implementation of an ammunition round counting device 68 is illustrated. In this view, the outside of the second module 72 is see-through to illustrate the inside of the device. The at least two light sensors are illustrated 72 below a plate 74. The plate 74 is used to keep components in the second module 70 secure. Such as, the at least two light sensors 72 in the counter module and the battery pack 76.

In places where the description above refers to particular implementations of ammunition round counting devices and implementing components, sub-components, methods and sub-methods, it should be readily apparent that a number of modifications may be made without departing from the spirit thereof and that these implementations, implementing components, sub-components, methods and sub-methods may be applied to other ammunition round counting devices.

What is claimed is:

1. An ammunition round counting device comprising:
- a first module and a second module coupled together, the first module and the second module configured to open and close around a belt of ammunition;
- a counter module comprising one of at least two proximity sensors and at least two light emitting diodes (LEDs);
- a display screen on an outside of the first module; and
- a battery pack operatively coupled with the counter module;
- wherein the counter module is configured to count a number of rounds in the ammunition belt that pass through the first module and the second module;
- wherein the first module and the second module are each not a portion of a firearm.

2. The ammunition round counting device of claim 1, wherein the display screen is reversibly couplable into the first module.

3. The ammunition round counting device of claim 1, furthering comprising a button on the outside of the first module, the button configured to allow a user to toggle the counter module between two or more modes of the display screen.

4. The ammunition round counting device of claim 1, wherein the at least two LEDs and at least two light sensors are configured to count a round in the ammunition belt as the round interrupts the light beam emitted from the at least two LEDs and received by the at least two light sensors.

5. The ammunition round counting device of claim 1, wherein the number of rounds in the ammunition belt can be counted in a first direction through the first module and the second module and in a second direction through the first module and the second module.

6. The ammunition round counting device of claim 1, wherein the distance between the at least two LEDs and the distance between the at least two light sensors is a predetermined distance.

7. The ammunition round counting device of claim 6, wherein the predetermined distance is 0.7215 inches.

8. The ammunition round counting device of claim 1, wherein the counter module is configured to count up to 3000 rounds of ammunition per minute.

9. An ammunition round counting device comprising:
- a first module;
- a second module; and
- a coupler at a first end of the first module and coupled at a first end of the second module, the coupler configured to allow the first module and the second module to open and close around a belt of ammunition;
- a counter module comprising a first section comprising a liquid crystal display (LCD) screen, the counter module coupled into the first module;
- one of at least two proximity sensors and at least two light emitting diodes (LEDs) comprised in the counter module;
- a button comprised on an outside surface of the first section of the counter module; and
- a battery pack comprised in the second module;
- wherein the counter module is configured to count a number of rounds of ammunition passing between the first module and the second module using one of the at least two proximity sensors and the at two least LEDs;
- wherein the first section of the counter module is reversibly couplable into the first module;
- wherein the first module and the second module are each not a portion of a firearm.

10. The ammunition round counting device of claim 9, wherein the button is configured to allow a user to toggle the counter module between two or more modes of the LCD screen.

11. The ammunition round counting device of claim 9, wherein the distance between the one of at least two LEDs and the at least two proximity sensors is a predetermined distance.

12. The ammunition round counting device of claim 11, wherein the predetermined distance is 0.7215 inches.

13. The ammunition round counting device of claim 9, wherein the counter module is configured to count up to 3000 rounds of ammunition per minute.

14. The ammunition round counting device of claim 9, wherein the number of rounds in the ammunition belt can be counted in a first direction through the first module and the second module and in a second direction through the first module and the second module.

15. A method for counting ammunition using an ammunition round counting device, the method comprising:
- placing a belt of ammunition between a first module and a second module;
- passing the belt of ammunition adjacent one of two or more proximity sensors and two or more LEDs comprised in the first module;

creating at least one state through detecting the passing of each round of ammunition in the belt of ammunition using the one of the two or more proximity sensors and the two or more LEDs;

using the at least one state to count each round of ammunition in the belt of ammunition as having passed through the first module and the second module using a processor and a memory comprised in one of the first module, the second module and both the first module and the second module;

wherein the first module and the second module are each not a portion of a firearm.

16. The method of claim 15, wherein the two or more LEDs are pulsed toward two or more light sensors comprised in the second module at a 2 kHz frequency and the at least one state includes 5 to 10 pulses.

17. The method of claim 16, further comprising interrupting a beam of light emitted by the two or more LEDs using a round of ammunition in the belt of ammunition and detecting the interruption using two or more light sensors.

18. The method of claim 15, further comprises at least three states which includes 1,0; 0,1; and 0,0.

19. The method of claim 18, wherein the round of ammunition can be counted in a first direction through the first module and the second module and a second direction through the first module and the second module.

20. The ammunition round counting device of claim 1, wherein the device is configured to count rounds of ammunition for a firearm using gunpowder ammunition.

* * * * *